United States Patent [19]

Kirkup et al.

[11] 4,415,875

[45] Nov. 15, 1983

[54] CIRCUIT BREAKER

[75] Inventors: Joseph F. Kirkup, Parma; Randall A. Horning, Jackson, both of Mich.

[73] Assignee: Mechanical Products, Inc., Jackson, Mich.

[21] Appl. No.: 379,283

[22] Filed: May 18, 1982

[51] Int. Cl.[3] ..... H01H 71/16

[52] U.S. Cl. ..... 337/62; 337/66; 337/67

[58] Field of Search ..... 337/62, 64, 65, 66, 337/67

[56] References Cited

U.S. PATENT DOCUMENTS 3,210,501 10/1965 Clarke ..... 337/62

4,091,351 5/1978 Flory et al. ..... 337/62

*Primary Examiner*—George Harris

*Attorney, Agent, or Firm*—Lyman R. Lyon

[57] ABSTRACT

The disclosure relates to an electrical circuit breaker comprising a housing having a pair of external terminals for connection to a source of electrical current. Current responsive means is supported internally of the housing and electrically connected to said terminals and to separable internal contacts. Current flow through said current responsive means effects separation of said contacts upon the occurrence of a predetermined electrical condition. A fusible element disposed externally of said housing is electrically connected in series with said contacts and current responsive means and is operable to effect interruption of the electrical circuit through said circuit breaker upon failure of said current responsive means to respond to said predetermined electrical condition.

3 Claims, 4 Drawing Figures

CIRCUIT BREAKER

BACKGROUND OF THE INVENTION

The instant invention is an improvement on the inventions disclosed in U.S. Pat. Nos. 3,287,523; 3,416,113 and 3,629,762 which are assigned to the assignee of the instant invention.

SUMMARY OF THE INVENTION

The invention relates to provision of an external fusible element in juxtaposed relation to a circuit breaker. The fusible element is disposed in series relationship to a conventional current-responsive bimetal. The fusible element provides positive protection to an electrical circuit in the event the circuit breaker fails to trip.

DETAILED DESCRIPTION OF THE PREFERRED EMBODIMENT OF THE INVENTION

Figure 1:
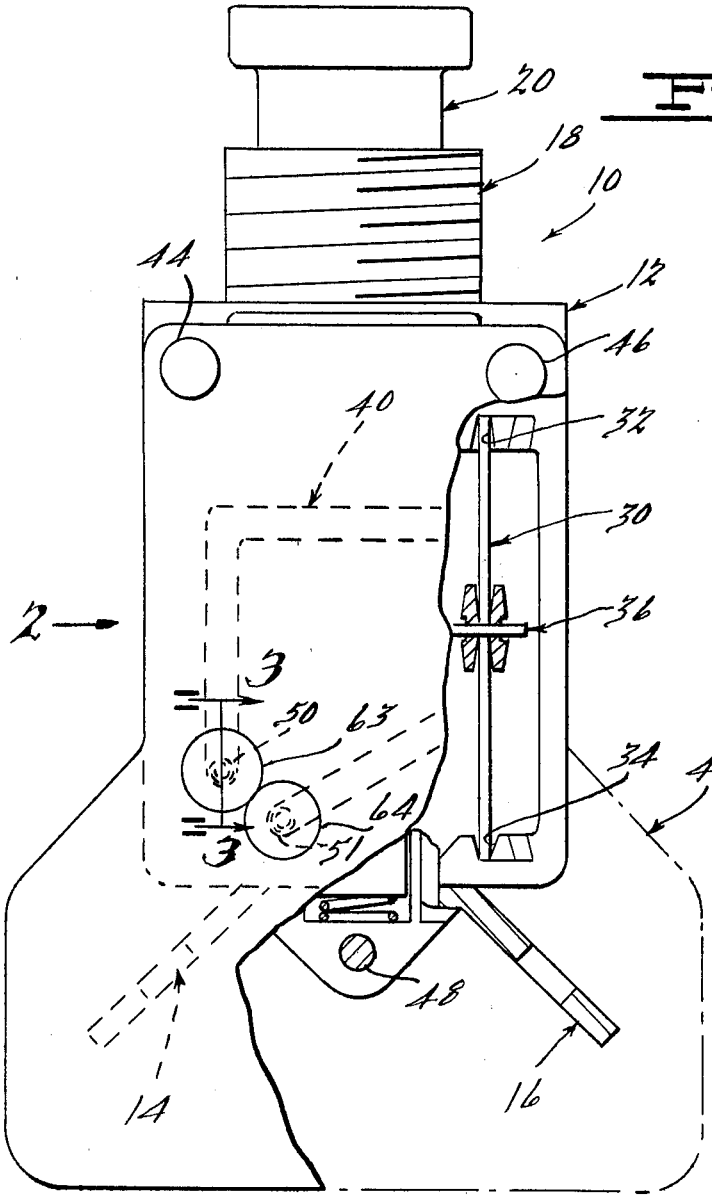
FIG. 1 is an elevational view, partially in section, of an improved circuit breaker in accordance with the instant invention.

As best seen in FIG. 1, a circuit breaker 10, in accordance with an exemplary constructed embodiment of the instant invention, comprises an enclosure 12 having a pair of terminals 14 and 16 thereon which extend exteriorly of the enclosure 12 for connection to a source of electrical energy. A threaded ferrule 18 extends exteriorly of the enclosure 12 for the journaling of a manual operator 20. The ferrule 18, in conjunction with a nut (not shown), provides a mounting means for the circuit breaker 10 on a panelboard (not shown).

Opposite ends of a current-responsive bimetal 30 are supported internally of the housing 12 in complementary recesses 32 and 34. The bimetal 30 effects control of a latch slide 36 which, in turn, trips the circuit breaker 10 upon the occurrence of an overload or fault condition in an electrical circuit containing the breaker 10. Reference should be made to U.S. Pat. No. 3,629,762 for the details of the trip and operating mechanisms of the circuit breaker 10, said mechanisms and the operation thereof forming no part of the instant invention.

In accordance with the instant invention, the circuit breaker 10 is provided with a fusible element 40 that is connected in electrical series relationship with the bimetal 30 and terminal 14 and 16. The fusible element 40 comprises, for example, a metallic film, the material, thickness and width of which varies in accordance with the current rating of the circuit breaker 10. The fusible element 40 functions to protect the wiring of a circuit containing the circuit breaker 10 in the event the circuit breaker's trip mechanism fails to open the circuit in the event of an overload or short circuit therein. The rating and material from which the fusible element 40 is made is preferably selected so as to allow for trip of the circuit breaker 10 under normal overload conditions. The fusible element 40 may provide a time delay function which, in the event of failure of the circuit breaker to trip under high overloads, will effect disruption of the electrical circuit after a predetermined time current function.

The fusible element 40 is bonded to an insulating panel or barrier 42, for example, a epoxy resin glass fabric, N.E.M.A. Grade FR-4 per mil Spec P-18177. The panel 42 is provided with holes therein for the acceptance of a plurality of rivets 44, 46 and 48 used to retain components of the housing 12 of the circuit breaker 10 together as well as the panel 42 to the housing 12.

Figure 3:
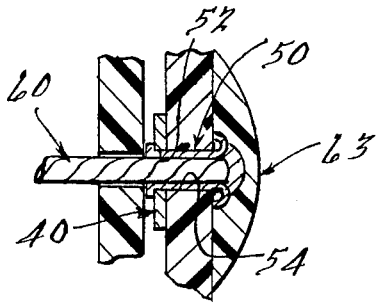
FIG. 3 is a view taken along the line 3—3 of FIG. 1.
Figure 2:
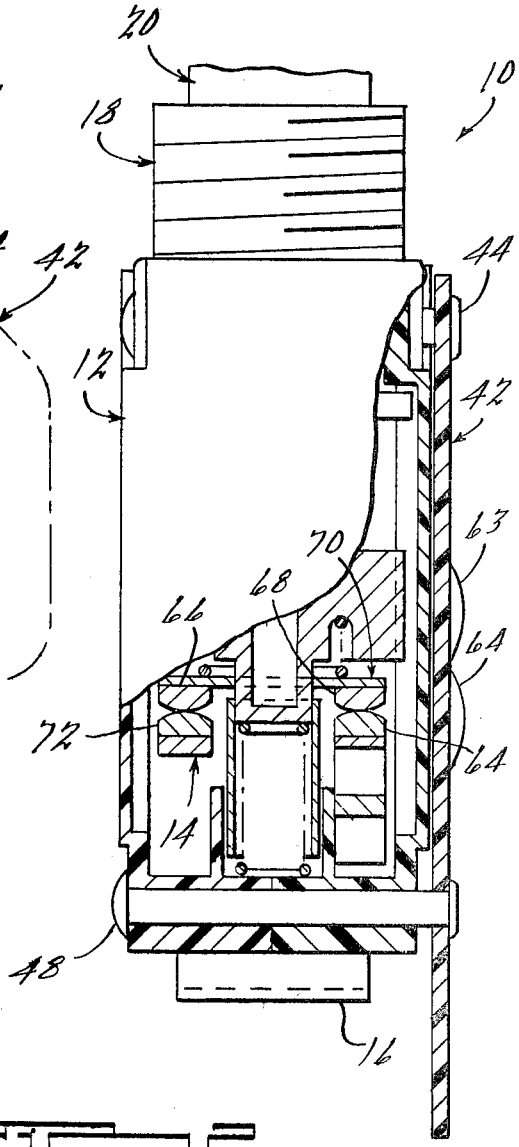
FIG. 2 is a view taken in the direction of the arrow 2 of FIG. 1.

As best seen in FIG. 3 of the drawings, eyelets 50 and 51 are provided at each end of the fusible element 40, that extend through aligned complementary apertures 52 and 54 in the fuse element 40 and panel 42. A pair of braided electrical conductors 60 and 62 extend through the spaced eyelets 50 and 51, respectively, the outer ends of which are soldered to the eyelets 50, 51 and thereafter covered by epoxy insulating layers 63 and 64, respectively.

Figure 4:
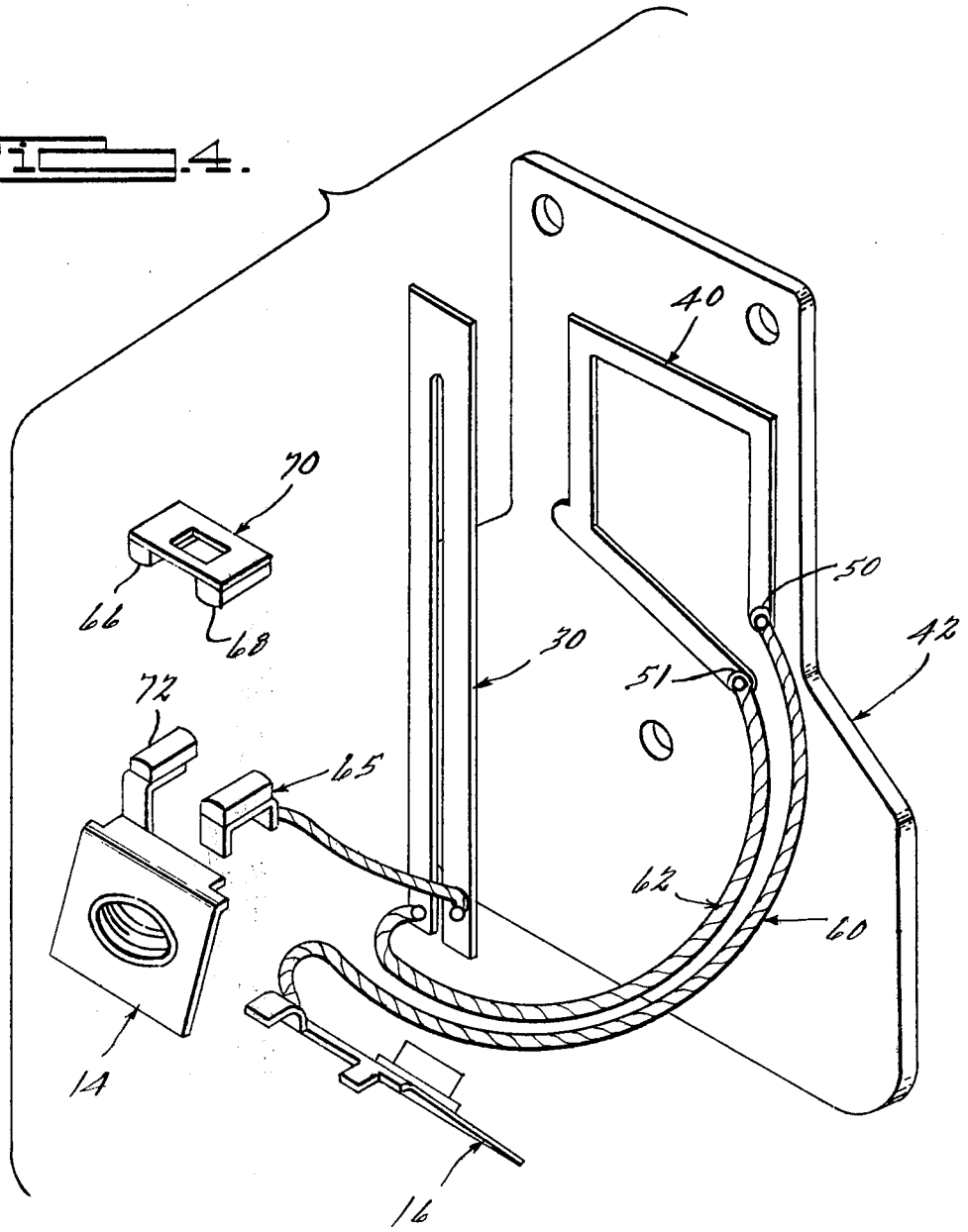
FIG. 4 is an exploded view illustrating electrical continuity between the contact assembly, bimetal, and fusible element.

As best seen in FIG. 4 of the drawings, one end of the fusible element 40 is electrically connected to the terminal 16 by the braided electrical conductor 60. The opposite end of the fuse element 40 is electrically connected to one end of the bimetal 30 by the braided fusible electrical conductor 62. The opposite end of the bimetal 30 is connected to one fixed contact 64. Electrical continuity through the circuit breaker is completed upon closure of contacts 66 and 68 on a movable contact bridge 70 with a fixed contact 72 on the terminal 14 and the fixed contact 64.

From the foregoing description it should be apparent that the fusible element 40 of the instant invention is relatively easily added to an existing circuit breaker thereby to provide positive fusible protection to an electrical circuit containing the circuit breaker. The normal functions of the circuit breaker, for example, manual opening and closing, ambient temperature compensation, are maintained. The fusible element 40 is fully protected against mechanical damage and electrical shorting by its location between the housing 12 of the circuit breaker 10 and the insulating panel or barrier 42.

While the preferred embodiment of the invention has been disclosed, it should be appreciated that the invention is susceptible of modification without departing from the scope of the following claims.

We claim:

1. An electrical circuit breaker comprising:

a housing;

a pair of external terminals supported by said housing for connection to a source of electrical current;

an internal fixed contact supported by said housing connected to one of said terminals;

a contact carrier having a movable contact thereon which is movable with respect to said housing to a closed position wherein said movable contact is engaged with said internal contact;

current responsive means supported internally of said housing and electrically connected to said terminals when said movable contact is engaged with said fixed contact and responsive to current flow therethrough to effect separation of said contacts upon the occurrence of a predetermined electrical condition and, a fusible element disposed externally of said housing and electrically connected in series with said contacts and operable to effect interruption of the electrical circuit through said circuit breaker upon failure of said current responsive means.

2. A circuit breaker in accordance with claim 1 wherein said fusible element comprises a relatively thin flat metallic conductor supported by an insulating panel in juxtaposed relation to an exterior wall of said housing.

3. A circuit breaker in accordance with claim 2 wherein said fusible element is electrically connected to said fusible element by flexible electrical connectors extending through a wall of said housing.

* * * * *